United States Patent [19]

Näpflin

[11] 3,976,308

[45] Aug. 24, 1976

[54] SAFETY SKI BINDING

[76] Inventor: Hans Näpflin, Kastanienallee 5, 6375 Beckenried, Switzerland

[22] Filed: July 2, 1975

[21] Appl. No.: 592,662

[30] Foreign Application Priority Data

| | | |
|---|---|---|
| July 2, 1974 | Switzerland | 9083/74 |
| Mar. 12, 1975 | Switzerland | 3099/75 |

[52] U.S. Cl. ..... 280/626

[51] Int. Cl.[2] ..... A63C 9/08

[58] Field of Search ..... 280/11.35 T

[56] References Cited

UNITED STATES PATENTS

| | | | |
|---|---|---|---|
| 3,791,675 | 2/1974 | Feichtinger | 280/11.35 T |
| 3,866,929 | 2/1975 | Lacroix | 280/11.35 T |
| 3,870,326 | 3/1975 | Cubberley | 280/11.35 T |
| 3,874,685 | 4/1975 | Besser | 280/11.35 T |

*Primary Examiner*—Robert R. Song
*Attorney, Agent, or Firm*—Karl F. Ross; Herbert Dubno

[57] ABSTRACT

A clamp for a safety ski binding has a housing adapted to be secured to a ski and formed with a part-spherical seat. A pin has a ball head in the seat for swiveling of the pin within the seat. An abutment surface on the housing lies in a plane passing substantially through the center of curvature of the seat and a pressure element slidable on the pin has an end face engageable against the surface of the housing. A spring is compressed between the pin and the pressure element so as to hold the two in a normal position from which the pin may be tipped for release of the skiboot. Means is provided for limiting the axial displacement of the ball head in the seat.

10 Claims, 8 Drawing Figures

FIG. 1
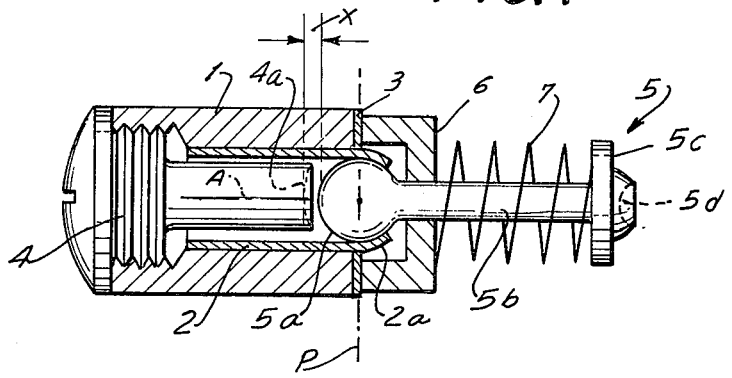
FIG. 2
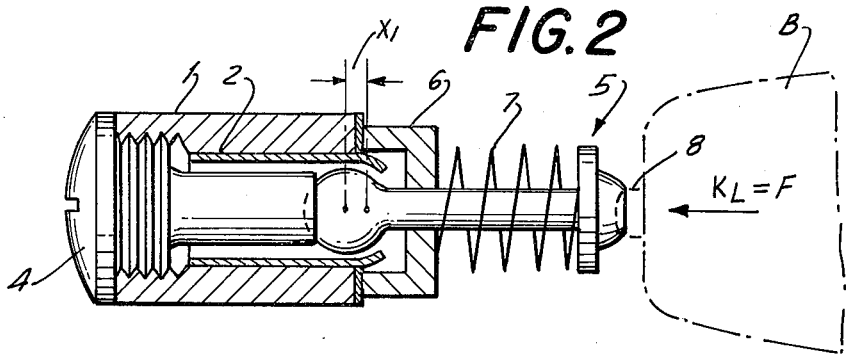
FIG. 3
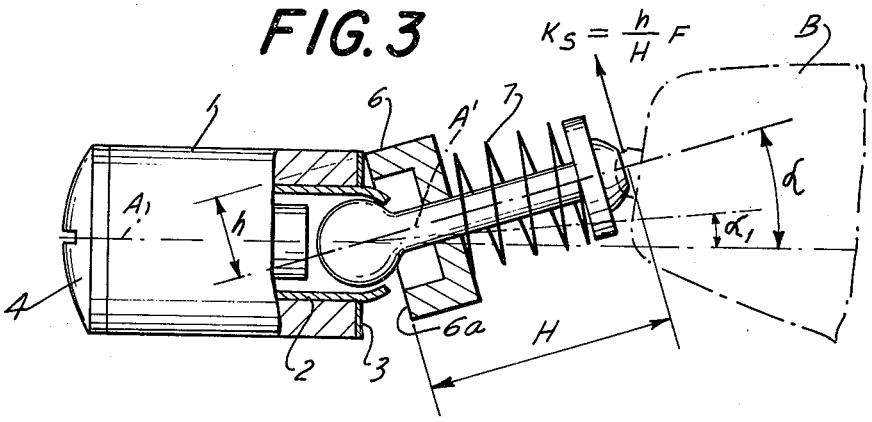
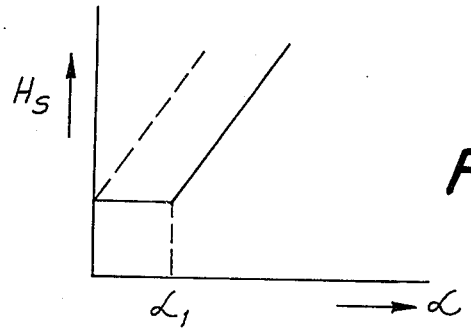
FIG. 3a

SAFETY SKI BINDING

CROSS REFERENCE TO RELATED APPLICATION

This application is related to my copending and commonly filed patent application Ser. No. 592,663 of July 1975.

FIELD OF THE INVENTION

The present invention relates to a ski binding. More particularly this invention concerns a spring-loaded clamp for a safety ski binding.

BACKGROUND OF THE INVENTION

A safety ski binding usually has a toe clamp and a heel clamp adapted respectively to secure the toe and heel of a ski boot to the ski. At least one of these clamps is provided with a release mechanism that allows the respective part of the boot to pull free when it exerts a force exceeding a predetermined maximum level on the clamp. In this manner, in case of a fall or other skiing accident, the skiboot will pull free from the ski and injury to the skier will be minimized.

In a very popular and simple system the reslease clamp is provided with a generally cylindrical sleeve having an inwardly directed lip at its end toward the skiboot and an opposite closed end. A pressure pin has a broad cylindrical head received in the sleeve and a relatively thin shank extending from the sleeve and having an outer end adapted to fit within a corresponding recess either on the skiboot or on a sole plate carried thereon. A spring in the sleeve is braced at one end against the closed end of the sleeve and at the other end against the face of the cylindrical head of the pin so as to press this pin with a predetermined force against the skiboot or plate thereon. See for example German patent 2,254,268.

A disadvantage of such a system is that when enough pressure is exerted axially on the pin to displace it back against the spring, the pin then very readily tips within th sleeve so as to free the skiboot or skiboot plate. If a very stiff spring is provided to minimize this danger the binding is almost completely ineffective. Since as a rule the clamp should release both when the skiboot is tipped up and when it is slid longitudinally within the binding, this type of structure is very disadvantageous as once the ski has been slid longitudinally to a limited extent the boot can easily slip out of the binding.

OBJECTS OF THE INVENTION

It is therefore an object of the present invention to provide an improved ski-binding clamp.

Another object is the provision of an improved clamp for a safety ski binding wherein the sideways release force does not drop off drastically if the pressing pin is depressed.

SUMMARY OF THE INVENTION

These objects are attained according to the present invention in a clamp adapted to be secured to a ski and formed with a part-spherical seat. A pin has a spherical ball head received in the seat so that it is swivelable in the seat on the head. An abutment surface is provided on the housing lying in a plane passing substantially through the center of curvature of the seat and a pressure element is slidable on the pin and has one end face engageable against the surface and an opposite end turned away from the surface. A spring is compressed between the pin and the opposite end of the pressure element for pressing the element against the surface.

With the arrangement according to the present invention the force resisting swiveling of the pin increases rather than decreases on depression of this pin within the housing.

According to yet another feature of this invention the face is annular and engages the surface all around the ball head. The distance from the center of curvature of the ball head and this part-spherical seat to that portion of the face of the pressure element furthest from the ski is substantially greater than the distance between this center and that portion of the pressure element closest to the ski so that a lever effect is achieved and greater force is needed to lift the holddown element carried on the end of the pin than to twist it sideways. To effect this the face is formed generally as a trapezoid section.

According to yet another feature of this invention means is provided for limiting longitudinal or axial displacement of the ball within the seat, that is a stop is provided which either prevents the ball head from lifting from the seat or limits the displacement of the ball head off the seat. This type of action is desirable for an expert skier who only wishes his bindings to be released when his boots twist or lift off the ski, but does not want them to release merely because his boot has slid forward or backward on the ski.

In accordance with yet another feature of this invention the spring comprises an elastomeric sleeve having one end engaged against the pressure element and another end engaged against the holddown element on the front end of the pin.

BRIEF DESCRIPTION OF THE DRAWING

The above and other objects, features, and advantages of the invention will become more readily apparent from the following description, reference being made to the accompanying drawing in which:

FIG. 1 is a longitudinal section through a clamp according to this invention;

FIGS. 2 and 3 are views similar to FIG. 1 illustrating operation of the clamp of FIG. 1;

FIG. 3*a* is a diagram illustrating schematically the operation of the clamp of FIGS. 1 – 3;

SPECIFIC DESCRIPTION

Figure 6:
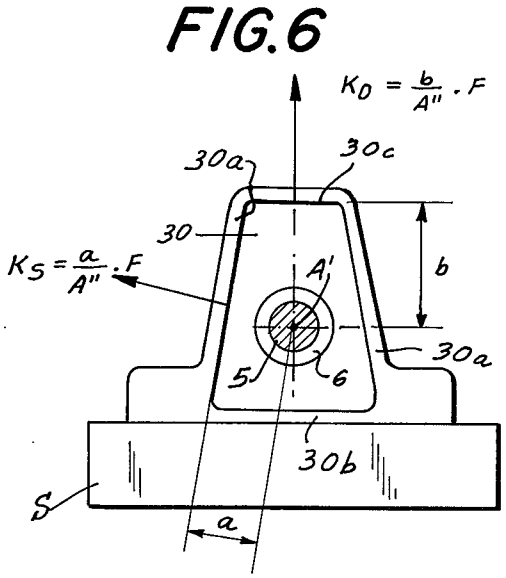
FIG. 6 is a section taken along line VI—VI of FIG. 4.

The clamp according to the present invention as shown in FIG. 1 basically comprises a tube 1 of aluminum fitted internally with a cylindrical steel tube 2 having an end forming an annular seat 2*a* of part-spherical shape with a center of curvature *z*. The support tube 1 has a planar end surface 3 lying in a plane P including the center of curvature *z*.

A pressing pin 5 has a ball head 5*a* received in a seat 2*a*. Extending from this head 5*a* is a relatively thin shank 5*b* terminating at an end abutment element 5*c* which is formed with a semispherical concavity 5*d*. An abutment plate 6 has an annular face 6*a* (FIG. 3) which is planar and which can lie flush against the end face 3. A compression spring 7 has one end braced against the abutment 5c and another end braced against the plate 6 so as to urge this surface 6a against the surface 3 and to pull the ball head 5a tightly into the seat 2a. A screw 4 threaded into the tube 1 is formed at its end turned toward the head 5a with a semispherical recess 4a of the same radius of curvature as the head 5a and spaced from this head by a distance $x$ corresponding to the amount of play along the axis A of the tube 1 that the pin 5 can move.

FIG. 2 shows how the arrangement can be used with a boss 8 on a skiboot B fitting into the part-cylindrical recess 5d so that the pin 5 is pressed back through a distance $x_1$ and almost bottoms in the concavity 4a. If play is left the axial stressing force $K_L$ is equal to the spring force F. When the clamp at the other end of the boot B itself has a spring whose force is greater than that of the force F, the play $x$ will be equal to zero. If however the element at the other end of the boot is rigid the binding must be so adjusted that a limited play is left. In this case the stressing force $K_L$ will equal F.

FIG. 3 shows what happens when the boot B is twisted to swivel the pin 5 in the seat 2a. In this case the lateral displacement takes place in two stages.

First of all on swinging of the pin 5 through an angle $\alpha_1$ only a slight amount of force is needed until the play $x_1$ (see FIG. 2) is reduced to zero and the head 5a comes to rest in the seat 2a. This occurs because the length of the spring 7 can hardly be reduced through the first part of the swiveling so that the stress added is approximately equal to the prestressing. Only a swiveling such as shown in FIG. 3 does the distance between the plate 6 and the end piece 5c lessen so as to further compress the spring 7. In this case the lateral swiveling force $K_S$ is lessened by the extent determined by the relationship $h/H$, $h$ being the distance between the axis A′ of the pin 5 and the outer edge of the plate 6 and H being the overall distance between the end of the piece 5c and the plane of the surface 6a.

Thus as illustrated by a solid line in FIG. 3a for a swiveling of the pin 5 through a relatively small angle $\alpha_1$ the swiveling force $K_S$ remains relatively even, thereafter as the boot B swivels the pin 5 through a greater angle $\alpha$ the force becomes linearly greater. When the arrangement is set up so as to eliminate the play $x$ the force will rise as shown by the dash line in FIG. 3a.

It is to be understood that the swiveling force is equal to the restoring force. Thus a boot held in a binding according to the present invention can push relatively far from a straight central position and return without being released by the binding. The skiboot is only released by the binding when the boss 8 pulls out of the recess 5d, as happens after displacement of the boot so as to swivel the pin through angle $\alpha$.

Figure 4:
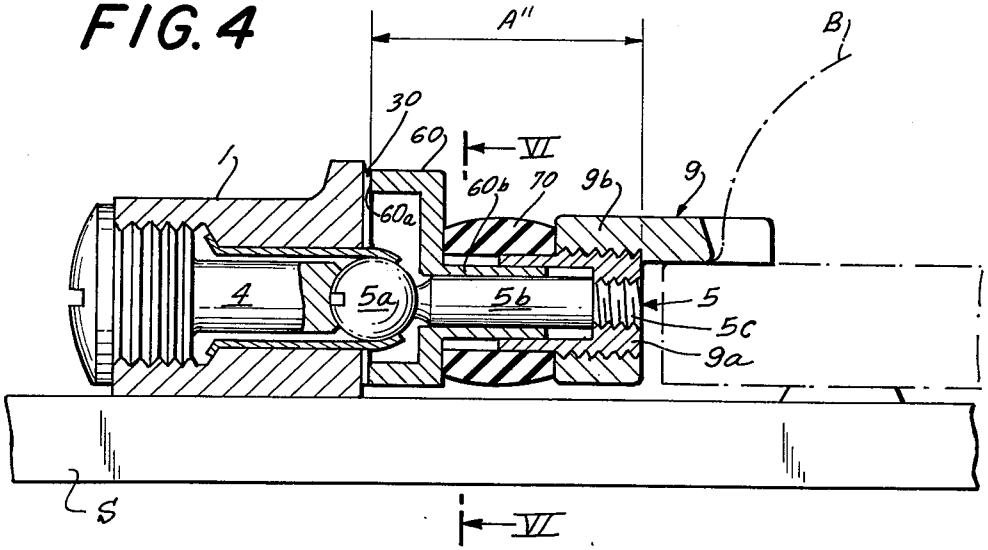
FIG. 4 is a longitudinal section through another arrangement in accordance with this invention.
Figure 5:
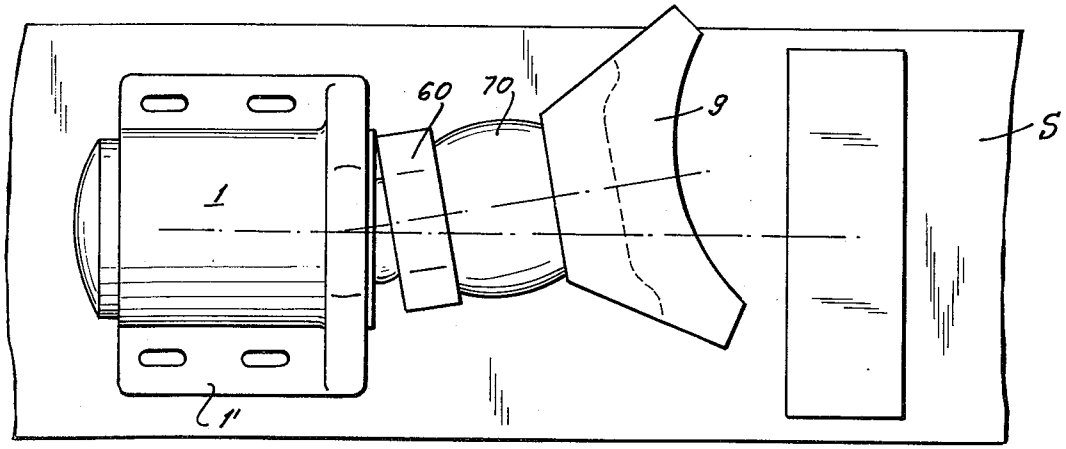
FIG. 5 is a top view of the arrangement of FIG. 4.

FIGS. 4–6 show another arrangement according to the present invention where identical reference numerals are used for identical structure. Here the housing 1 is shown mounted on a ski S and the screw 4 is shown in a position leaving no play between it and the ball head 5a of the screw 5. This pin 5 is provided with a threaded end 5e screwed into a sleeve 9a of a heel holddown 9 having another part 9b in turn screwed on over the part 9a. A spring in the form of an elastomeric sleeve 70 is compressed between the element 9b and an element 60 having an annular end face 60a bearing against the identical annular end face 30 of the housing 1. In addition this element 60 has a center core sleeve 60b slidable on the stem 5b of the pin 5 and within the tubular element 9a. The surface 30 and the face 60a are of like trapezoidal shape shown in FIG. 6.

The face 30 has two sides 30a tapering upward away from the ski S at an angle of 20° to each other, a base 30b lying on the ski S and a top side 30c parallel to the bottom side 30b and to th ski. The distance between the axis A′ of the pin 5 and the side surface 30a is equal to $a$ and the spacing between this axis A′ and the top 30c is equal to $b$.

FIG. 6 further indicates how the force necessary to swivel the pin 5 from side to side, $K_S$ is equal to $a/A'' \times F$ wherein distance A′ is the equivalent of the distance H of FIG. 3. The force $K_O$ necessary to tip the pin upwardly, however, is equal to $b/A'' \times F$. Since the distance $b$ equals approximately 2a a great deal more force is necessary to tip the boot up out of the binding than to twist it out of the binding. This is advantageous in that for lateral displacement there is also the friction between the sole of the skiboot B and the top of the ski to take into account, whereas for upward displacement there is no such friction.

Figure 7:
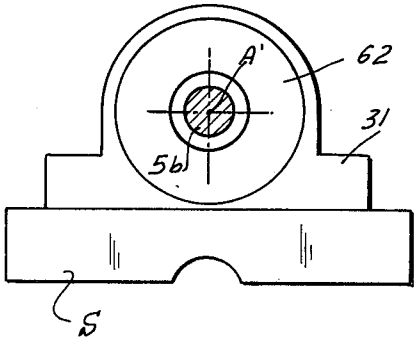
FIG. 7 is a view similar to FIG. 6 illustrating another arrangement in accordance with this invention.

FIG. 7 shows an arrangement wherein a support 31 equivalent to the support 1 has an end face 62 which is circular and centered on the axis A′. In such a system the force is the same to tip or swivel the pin 5 in any direction.

I claim:

1. A clamp for a ski binding, said clamp comprising:
- a housing adapted to be secured to a ski and formed with a part-spherical seat;
- a pin having at one end a ball head swivelable in said seat on said head;
- an abutment surface on said housing lying in a plane passing substantially through the center of curvature of said seat;
- a pressure element slidable on said pin and having one end face engageable against said surface, said pin having an opposite end engageable with the toe of a skiboot; and
- a spring compressed between said pin and said opposite end for pressing said element against said surface away from the toe of the skiboot.

2. The clamp defined in claim 1 wherein said housing is adapted to be secured to a side of said ski, said face having a width parallel to said side less than its height perpendicular to said side.

3. The clamp defined in claim 1 wherein said face is annular and engages said surface all around said seat, said pin having an axis surrounded by said face and closer to that portion of said face closest to said ski than to the portion of said face furthest from said ski.

4. The clamp defined in claim 1 wherein said face is generally trapezoidal with a wide base close and parallel to a surface of said ski, a pair of sides converging upwardly away from said surface of said ski, and a narrow top distant from and parallel to said surface of said ski.

5. The clamp defined in claim 1 wherein said face is circular.

6. The clamp defined in claim 1 wherein said pin is provided on one end with said ball head and on its opposite end with an abutment body, said spring surrounding said pin and being braced between said body and said element.

7. The clamp defined in claim 6 wherein said spring is a cylindrically annular tube of elastomeric material.

8. The clamp defined in claim 1 wherein said housing is formed with an elongated chamber formed in turn at said end with said seat, whereby said head is longitudinally displaceable in said chamber.

9. The clamp defined in claim 8, further comprising means displaceable longitudinally in said chamber for limiting the longitudinal displacement of said head therein.

10. The clamp defined in claim 9 wherein said means for limiting is a screw threaded into said housing.

* * * * *